US010766656B2

(12) United States Patent
Flores

(10) Patent No.: US 10,766,656 B2
(45) Date of Patent: Sep. 8, 2020

(54) FILM WRAPPING APPARATUS

(71) Applicant: Manuel Rodriguez Flores, La Habra, CA (US)

(72) Inventor: Manuel Rodriguez Flores, La Habra, CA (US)

( * ) Notice: Subject to any disclaimer, the term of this patent is extended or adjusted under 35 U.S.C. 154(b) by 71 days.

(21) Appl. No.: 15/919,154

(22) Filed: Mar. 12, 2018

(65) Prior Publication Data

US 2019/0276177 A1 Sep. 12, 2019

(51) Int. Cl.

| | |
|---|---|
| ***B65B 67/08*** | (2006.01) |
| ***B65H 16/00*** | (2006.01) |
| ***B65H 16/02*** | (2006.01) |

(52) U.S. Cl.

CPC ..... *B65B 67/085* (2013.01); *B65H 16/005* (2013.01); *B65H 16/021* (2013.01); *B65H 2301/4139* (2013.01); *B65H 2301/41282* (2013.01); *B65H 2402/412* (2013.01)

(58) Field of Classification Search

CPC ..... B65H 16/005; B65H 16/021; B65H 2301/41282; B65H 2301/4139; B65H 2301/412; B65H 23/06; B65H 2402/412; B65H 2402/41; B65H 2701/1944; B65H 75/185; B65B 67/085

See application file for complete search history.

(56) References Cited

U.S. PATENT DOCUMENTS

| | | | | |
|---|---|---|---|---|
| 1,950,745 | A * | 3/1934 | Patterson | B65H 75/406 242/395.1 |
| 4,600,163 | A * | 7/1986 | Hummel | B65B 67/085 242/422.1 |
| 5,779,179 | A * | 7/1998 | Zentmyer | B65B 67/085 242/423.2 |
| 10,464,467 | B2 * | 11/2019 | Robins | B63B 25/24 |
| 2011/0233321 | A1 * | 9/2011 | Yu Chen | B65B 67/085 242/588.2 |
| 2017/0305583 | A1 * | 10/2017 | Nelson | B65H 16/005 |
| 2018/0065827 | A1 * | 3/2018 | Nelson | B65H 16/005 |
| 2018/0222138 | A1 * | 8/2018 | Cercone | B29C 73/10 |
| 2018/0257889 | A1 * | 9/2018 | Walters | B65H 75/30 |
| 2018/0319311 | A1 * | 11/2018 | Chao | B60P 7/083 |

FOREIGN PATENT DOCUMENTS

| | | | | |
|---|---|---|---|---|
| EP | 1987-179742 | * | 7/1987 | |
| GB | 2333506 A | * | 7/1999 | B65H 23/06 |

* cited by examiner

*Primary Examiner* — Michael E Gallion
(74) *Attorney, Agent, or Firm* — Raymond Y. Chan; David and Raymond Patent Firm

(57) ABSTRACT

A film wrapping apparatus includes a shaft member having two holding portions coaxially aligned with each other, a roll locker for releasably locking two film rolls at the holding portions respectively in a free-rotating manner, and a dispensing handle transversely extended from the shaft member at a position between the holding portions thereof, wherein the dispensing handle provides a holding point for being held by an operator to unroll the film rolls in a concurrent and controllable manner so as to wrap stretch films of the film rolls around the load.

18 Claims, 5 Drawing Sheets

FILM WRAPPING APPARATUS

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to packaging and shipping systems, and more particularly to a film wrapping apparatus, wherein one or more plastic stretch wraps or tapes can be retained by the film wrapping apparatus to packaging units by encircling the wraps about the packaging units.

Description of Related Arts

In shipping and storing items, plastic stretch wrap or tape can be used for wrapping around the items to protect and secure the items in a load. Particularly, the items in a load can be tightly wrapped and protected by the stretch wrap to prevent any item falling from the load and any damage due to weather or impact. Generally speaking, a wrap dispenser comprises a spindle and a hand grip coaxially and rotatably coupled thereto, wherein a roll of stretch wrap is mounted to the spindle for being unrolled and dispensed to wrap around the items. For a smaller item, the operator, i.e. a labor or a packer, is able to control the wrap dispenser for unrolling the stretch wrap to wrap around the item. However, for a load of items, the operator must hold the wrap dispenser and walk around the load in order to unroll the stretch wrap to wrap around the load. A bigger sized wrap roll, such as having a width of at least 1 foot, can be used for rapidly wrapping around the load. However, such bigger wrap roll cannot fit the existing wrap dispenser, so that the operator must hold the wrap roll directly hold the wrap roll without the wrap dispenser to walk around the load.

In particular, the operator must use two hands to hold two ends of the wrap roll respectively to control the unrolling operation thereof, wherein the tension and speed of the unrolling of the wrap roll is controlled by the walking movement of the operator. It is often overlooked that holding the wrap roll by operator's hands to unroll thereof is not ergonomics of motion. In other words, the wrap roll cannot be free to rotate and may be unbalanced for unrolling due to the movement of the operator. Furthermore, the operator has to walk around the load from an awkward, bent over position to unroll the wrap roll, wherein back injuries and muscle strains often afflict the operator.

There is a need for retaining the wrap roll to controllably unroll thereof and for permitting the operator to securely hold the wrap roll without affecting the tension applied to the load.

SUMMARY OF THE PRESENT INVENTION

The invention is advantageous in that it provides a film wrapping apparatus which can efficiently dispensing and applying an elongated plastic stretch film from a roll.

Another advantage of the invention is to a film wrapping apparatus, which provides two or more handling portions for providing ergonomic motion of the operator to complete the wrapping operation.

Another advantage of the invention is to a film wrapping apparatus, wherein a larger film roll, such as a width thereof having at least 1 ft, can be mounted to the film wrapping apparatus for being dispensed.

Another advantage of the invention is to a film wrapping apparatus, wherein two or more stretch films can be dispensed at the same time in such a manner that the tensions and speeds of unrolling of the stretch films are concurrent and controllable during the application of the stretch films to the packaging units.

Another advantage of the invention is to a film wrapping apparatus, wherein different sizes of film rolls can be securely mounted to the film wrapping apparatus for unrolling the stretch film and wrapping around the packaging units.

Another advantage of the invention is to a film wrapping apparatus, which can hold any existing film roll to complete the wrapping operation, so as to minimize the additional cost of the film roll incorporating with the film wrapping apparatus.

Another advantage of the invention is to a film wrapping apparatus, which is simple and easy to operate, wherein an inexperienced person is able to operate the film wrapping apparatus to apply stretch film to the packaging units.

Another advantage of the invention is to a film wrapping apparatus, wherein the loading operation of the film roll is easy and simple that the user is able to easily and rapidly replace or change the film roll from the film wrapping apparatus.

Another advantage of the invention is to a film wrapping apparatus, which does not require altering the original structural design of the film roll, so as to minimize the manufacturing cost of the film wrapping apparatus incorporating with the film roll.

Another advantage of the invention is to a film wrapping apparatus, wherein no expensive or complicated structure is required to employ in the present invention in order to achieve the above mentioned objects. Therefore, the present invention successfully provides an economic and efficient solution for providing an effective tool for applying the stretch film and the like to the packaging units while being cost effective.

Additional advantages and features of the invention will become apparent from the description which follows, and may be realized by means of the instrumentalities and combinations particular point out in the appended claims.

According to the present invention, the foregoing and other objects and advantages are attained by a film wrapping apparatus for wrapping two or more film rolls around a load, comprising:

a roll holder comprising an elongated shaft member having at least a handling portion and two holding portions coaxially aligned with each other;

a roll locker provided at each of the holding portions of the shaft member for releasably locking the film rolls at the holding portions respectively in a free-rotating manner; and a dispensing handle transversely extended from the shaft member at a position between the holding portions thereof, wherein the handling portion of the shaft member and the dispensing handle provide at least two holding points for being held by an operator to unroll the film rolls in a concurrent and controllable manner so as to wrap stretch films of the film rolls around the load.

In accordance with another aspect of the invention, the present invention comprises a method for wrapping two or more film rolls around a load by a film wrapping apparatus which comprises an elongated shaft member and a dispensing handle, comprising the following steps.

(A) Load the film rolls at two holding portions of the shaft member respectively at a position that the dispensing handle is located therebetween. Accordingly, the film rolls are locked at the holding portions of the shaft member in a free-rotating manner.

(B) Hold the dispensing handle by an operator to unroll the film rolls in a concurrent and controllable manner so as to wrap stretch films of the film rolls around the load.

In accordance with another aspect of the invention, the present invention comprises a film wrapping apparatus, for wrapping a film roll, having a width of at least 1 foot, around a load, comprising:

a roll holder comprising an elongated shaft member having a handling portion defined at one end portion of the shaft member and a holding portion for holding the film roll at the holding portion; and a dispensing handle transversely extended from the shaft member at a position that the holding portion of the shaft member is located between the handling portion thereof and the dispensing handle, wherein the handling portion of the shaft member and the dispensing handle provide at least two holding points for being held by an operator to unroll the film roll in a controllable manner so as to wrap stretch films of the film roll around the load.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
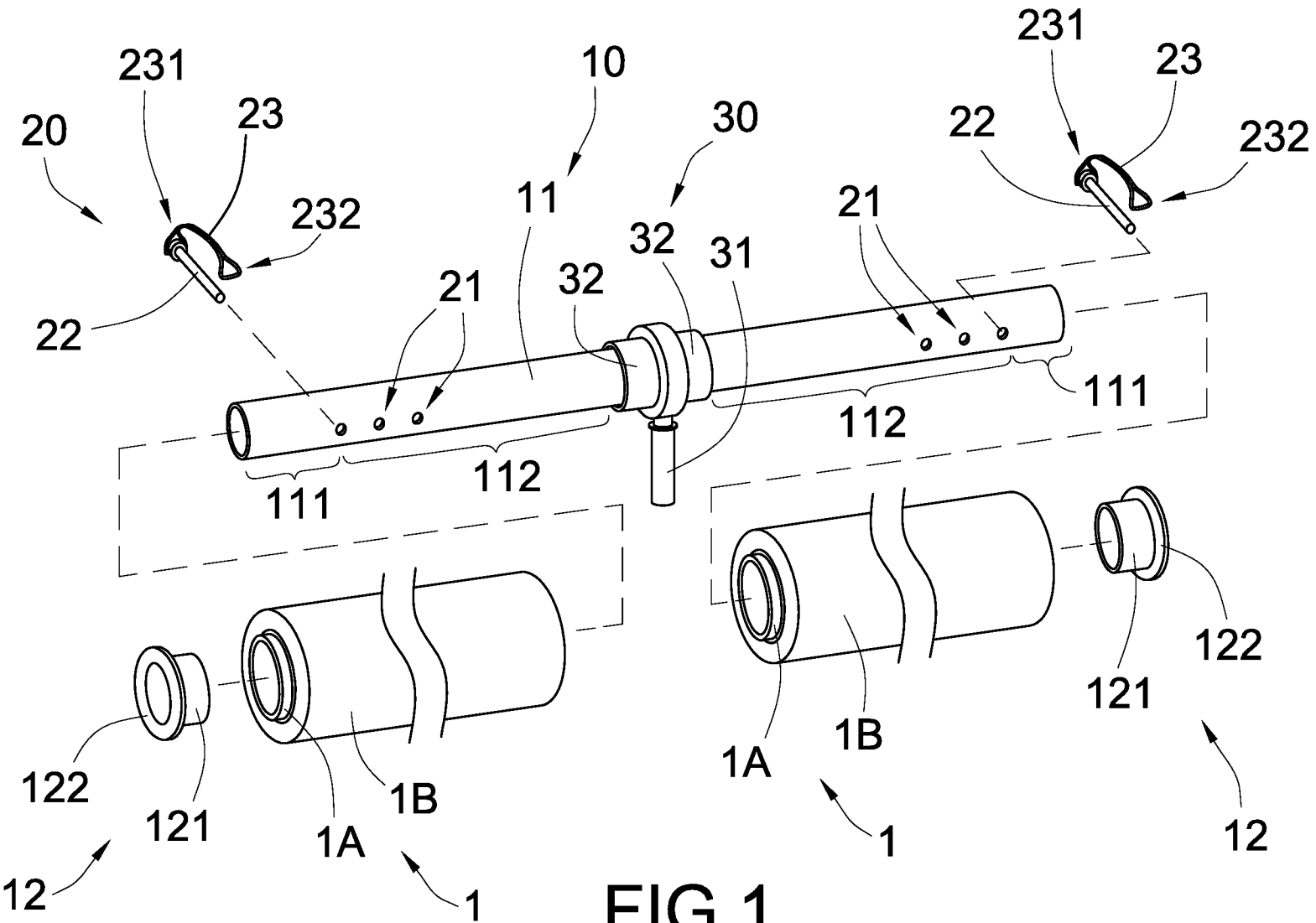
FIG. 1 is an exploded perspective view of a film wrapping apparatus according to a preferred embodiment of the present invention.
Figure 2:
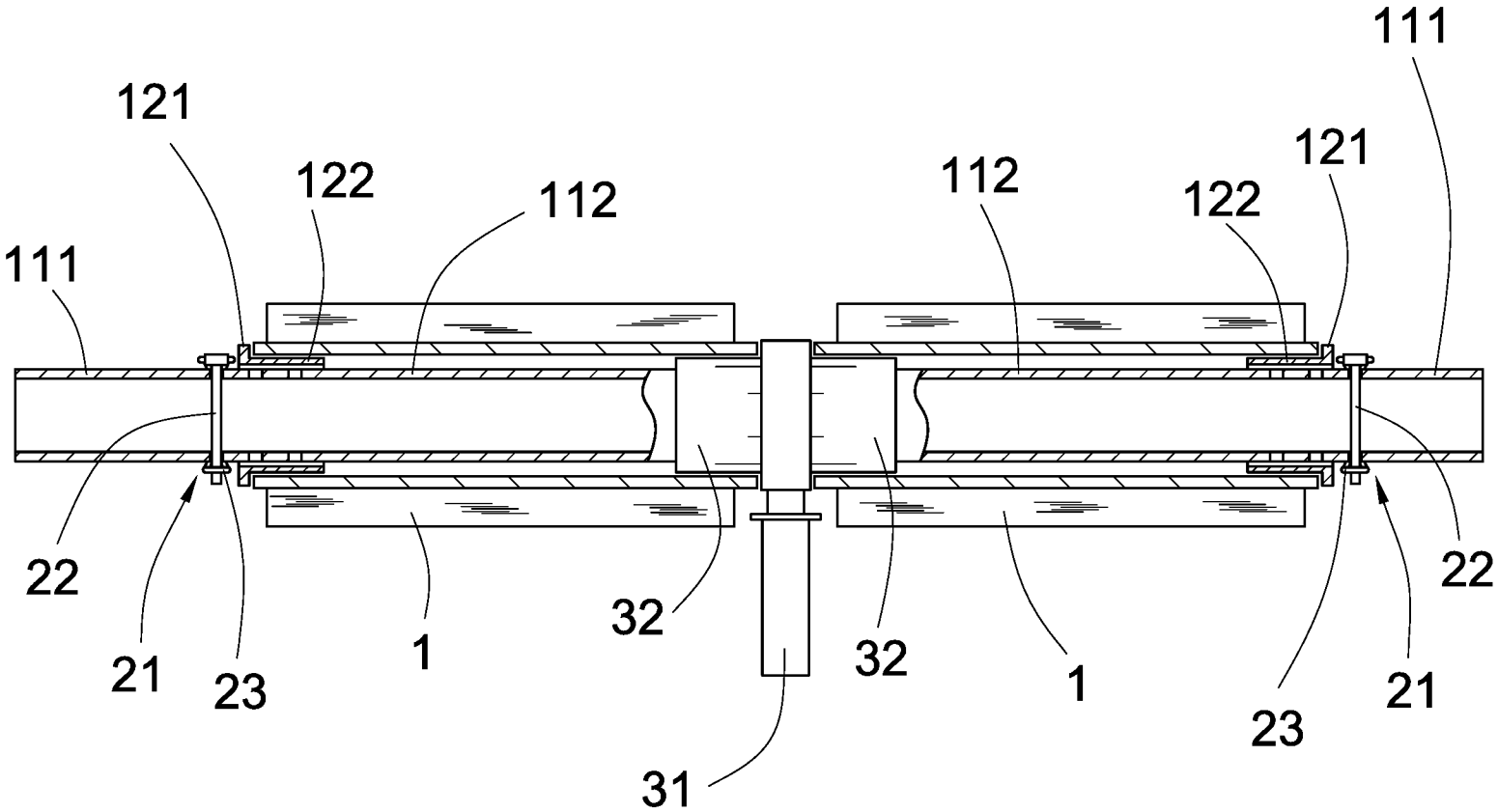
FIG. 2 is a sectional view of the film wrapping apparatus according to the above preferred embodiment of the present invention.

Referring to FIGS. 1 and 2 of the drawings, a film wrapping apparatus according to a preferred embodiment of the present invention, wherein the film wrapping apparatus is arranged for wrapping a film roll 1 around a load. Preferably, the film wrapping apparatus is able to hold and unroll two film rolls 1 at the same time in order to wrap around the load. Preferably, the film roll 1 has a width of at least 1 foot.

According to the preferred embodiment, the film wrapping apparatus comprises a roll holder 10, a roll locker 20, and a dispensing handle 30. The film roll 1 generally comprises a roll core 1A and a stretch film 1B rolled around the roll core 1A.

The roll holder 10 comprises an elongated shaft member 11 having at least a handling portion 111 and two holding portions 112 coaxially aligned with each other, wherein the film rolls 1 are held at the holding portions 112 of the shaft member 11 respectively. Preferably, the shaft member 11 has a cylindrical shape and is made of rigid but light weight material. The shaft member 11 has a mid-portion and two end portions, wherein each holding portion 112 of the shaft member 11 is defined between the mid-portion and one end portion. Therefore, the two film rolls 1 are coaxially aligned with each other when the film rolls 1 are retained at the holding portions 112 of the shaft member 11. The holding portions 112 of the shaft member 11 have equal diameter and length. In particular, the length of each holding portion 112 of the shaft member 11 is at least equal to, preferably longer than, a length of the film roll 1. The handling portion 111 of the shaft member 11 is defined at each of the end portions of the shaft member 11. Preferably, a length of one of the handling portions 111 of the shaft member 11 is longer than a length of another handling portion 111 thereof.

The roll locker 20 is provided at each of the holding portions 112 of the shaft member for releasably locking the film rolls 1 at the holding portions 112 of the shaft member 11 respectively in a free-rotating manner. In other words, the films rolls 1 can be rotatable about the holding portions 112 of the shaft member 11, wherein the roll locker 20 will retain the film rolls 1 to minimize an unwanted longitudinal movement of the film rolls 1 along the shaft member 11.

The dispensing handle 30 is transversely extended from the shaft member 11 at a position between the holding portions 112 thereof, wherein at least one of the handling portion 111 of the shaft member 11 and the dispensing handle 30 provides a holding point for being held by an operator to unroll the film rolls 1 in a concurrent and controllable manner so as to wrap stretch films 1B of the film rolls 1 around the load. It is worth mentioning that the operator is able to only grip at the dispensing handle 30 as a single holding point of the film wrapping apparatus for completing the wrapping operation while the handling portion 111 of the shaft member 11 is considered as an additional holding point or stabilizing point of the film wrapping apparatus for stabilizing thereof.

Figure 3:
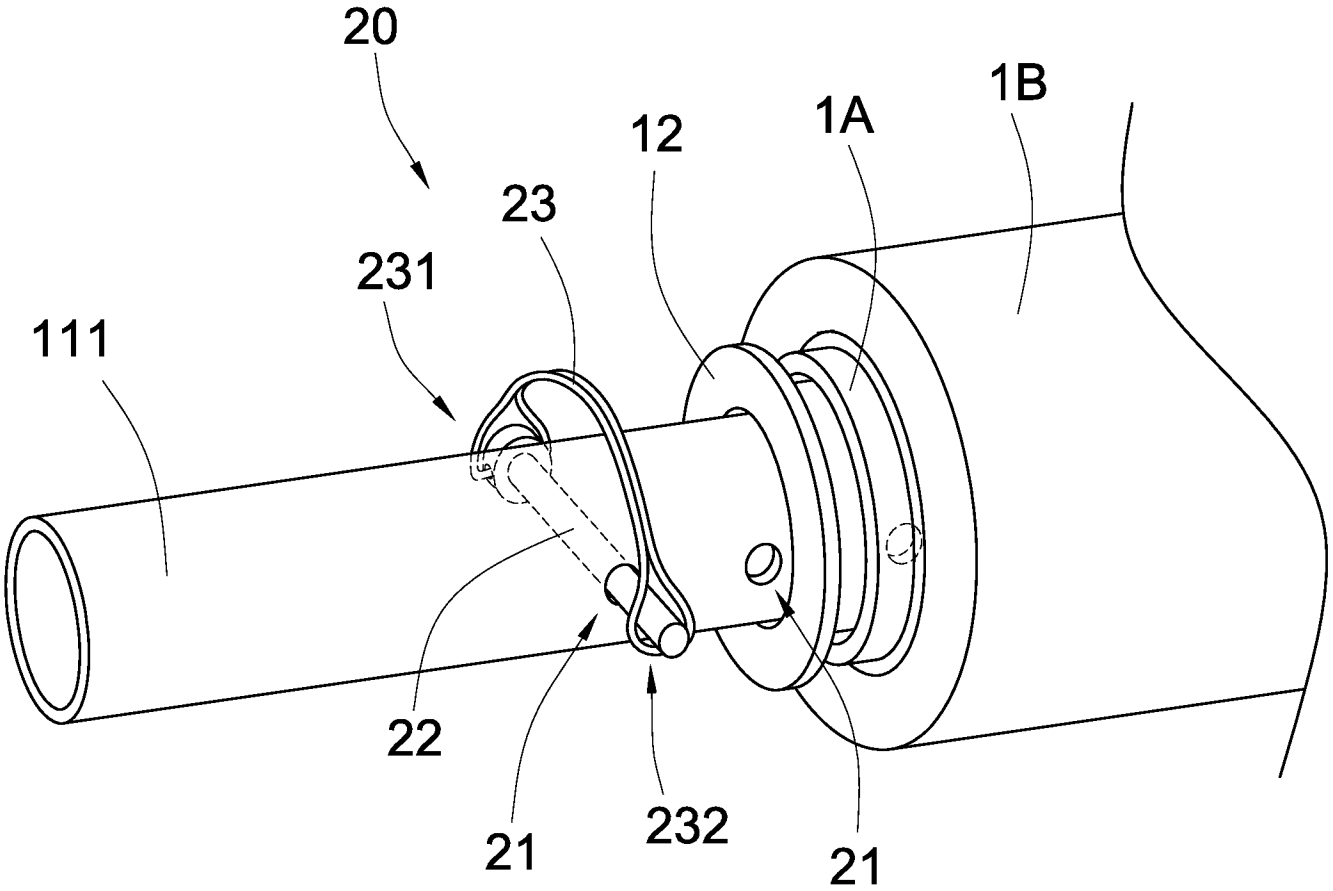
FIG. 3 is a perspective view of a roll locker of the film wrapping apparatus according to the above preferred embodiment of the present invention.

As shown in FIGS. 1 to 3, the roll locker 20 comprises a locking slot 21 transversely extended through the shaft member 11 adjacent to the holding portion 112 thereof, and a locking member 22 detachably passing through the locking slot 21 for locking the film roll 1 at the holding portion 112 of the shaft member 11. Accordingly, the locking member 22 is coupled at the shaft member 11 at a position adjacent to the outer end of the film roll 1.

Preferably, two or more one locking slots 21 are spacedly and alignedly provided at each of the holding portions 112 of the shaft member 11, wherein the locking member 22 is selectively coupled at one of the locking slots 21 to selectively adjust the length of the holding portion 112 of the shaft member 11. In other words, different sizes, i.e. different lengths, of the film rolls 1 can be fitted at the holding portion 112 of the shaft member 11. Preferably, two identical film rolls 1 are coupled at the holding portions 112 of the shaft member 11 respectively. It is appreciated that two different sizes of film rolls 1 can be coupled and locked at the holding portions 112 of the shaft member 11 respectively via the locations of the locking slots 21.

The locking member 22 has a length larger than a diameter of the shaft member 11 and is larger than a length of the locking slot 21. In other words, when the locking member 22 is slid to extend through the locking slot 21, two ends of the locking member 22 are extended out of the locking slot 21 and are protruded out of the shaft member 11. Therefore, the film roll 1 is locked at the holding portion 112 of the shaft member 11 while the film roll 1 can be free-rotated about the shaft member 11.

According to the preferred embodiment, the roll locker 20 further comprises a locking band 23 which has a fixing end 231 affixed to one end of the locking member 22 and a detachable end 232 detachably coupled at another end of the locking member 22 to lock up the locking member 22 at the shaft member 11. As shown in FIG. 3, the locking band 23 is made of flexible material, such as metal wire, adapted to be bent between the fixing end 231 and the detachable end 232 to have a C-shaped configuration. Accordingly, the fixing end 231 of the locking band 23 is pivotally coupled at one end of the locking member 22, wherein the detachable end 232 of the locking band 23 forms a loop form to encircle around the opposed end of the locking member 22. It is worth mentioning that the flexibility of the locking band 23 will reinforce the fixing end 231 and the detachable end 232 being engaged with the ends of the locking member 22 respectively. Therefore, when the detachable end 232 of the locking band 23 is pulled away from the locking member 22, the detachable end 232 of the locking band 23 is disengaged with the respective end of the locking member 22, so as to allow the locking member 22 to be slid and disengaged with the locking slot 21.

The roll holder 10 further comprises two rotatable reels 12 rotatably and coaxially coupled at the shaft member 11 for securely coupling at outer ends of the film rolls 1 respectively, wherein the rotatable reels 12 are arranged for stabilizing the rotational movements of the film rolls 1 about the holding portions 112 of the shaft member 1 respectively.

As shown in FIGS. 1 and 2, each of the rotatable reels 12 comprises a rotating core 121 adapted for coupling at the outer end of the film roll 1, and an outer flange 122 integrally and coaxially extended from an outer edge of the rotating core 121 for covering at the outer end of the film roll 1. Accordingly, a diameter of the rotating core 121 is smaller than an inner diameter of the film roll 1, such that the rotating core 121 is arranged for inserting into the outer end of the film roll 1, i.e. inserting into the roll core 1A of the film roll 1. In particular, the diameter of the rotating core 121 is slightly larger than a diameter of the shaft member 11, such that the rotating core 121 is free to rotate about the shaft member 11. A diameter of the outer flange is larger than the inner diameter of the film roll 1, such that when the rotating core 121 is inserted into the outer end of the film roll 1, the outer flange 122 is extended to cover at the outer end of the film roll 1. It is worth mentioning that the rotating core 121 is provided to minimize a friction between the rotating core 121 and the shaft member 11 to enhance the smooth rotating movement of the film roll 1 about the shaft member 11 during the wrapping operation, i.e. the unrolling the film roll 1.

According to the preferred embodiment, the dispensing handle 30 comprises a hand grip 31 transversely extended from the shaft member 11 and two reel guiders 32 extended from the hand grip 31 in an opposite direction for coupling at the inner ends of the film rolls 1 respectively, as shown in FIGS. 1 and 2.

The operator is able to hold the hand grip 31 in order to lift up the shaft member 11 in a vertical manner. Preferably, the hand grip 31 is perpendicularly extended from the shaft member 11 at the mid-portion thereof between the holding portions 112 of the shaft member 11.

The reel guiders 32 are integrally extended from the hand grip 31 towards the holding portions 112 of the shaft member 11 respectively, wherein the reel guiders 32 are non-rotatably coupled at the shaft member 11, such that the reel guiders 32 cannot be rotated about the shaft member 11. Accordingly, a diameter of each of the reel guiders 32 is smaller than the inner diameter of the film roll 1, wherein when the reel guider 32 is inserted into the inner end of the film roll 1, i.e. inserted into the roll core 1A of the film roll 1, the film roll 1 can be rotated at the reel guider 32. In other words, the reel guider 32 is rotatably coupled at the film roll 1.

It is worth mentioning that the outer and inner ends of the film roll 1 are rotatable about the shaft member 11. In particular, the outer end of the film roll 1 is detachably coupled at the rotatable reel 12 that the rotatable reel 12 is rotatably coupled at the shaft member 11. The inner end of the film roll 1 is detachably and rotatably coupled at the reel guider 32. Therefore, two different frictions are created at the rotational movement of the film roll 1 to control the tension and speed of unrolling of the stretch films 1B during the wrapping operation. One friction is created between the rotatable reel 12 and the shaft member 11 at the outer end of the film roll 1 while another friction is created between the inner end of the film roll 1 and the reel guider 32. Through these two different frictions, the operator is able to apply the pulling force at the film wrapping apparatus to control the tension and speed of unrolling of the stretch films 1B during the wrapping operation.

According to the preferred embodiment, a wrapping method of the present invention comprises the following steps.

(1) Loading Step of the Film Rolls 1.

Load the film roll 1 at the holding portion 112 of the shaft member 11 by slidably and coaxially inserting the shaft member 11 into the shaft member 11. It is worth mentioning that only one film roll 1 can be held at one of the holding portions 112 of the shaft member 11. Preferably, two film rolls 1 are rotatably and coaxially coupled at the holding portions 112 of the shaft member 11 respectively, such that the dispensing handle 30 is located between the two film rolls 1. It is important that the unrolling direction of the stretch films 1B of the film rolls 1 should be the same when the film rolls 1 are loaded at the holding portions 112 of the shaft member 11.

Accordingly, the inner ends of the film rolls 1 are rotatably engaged with the reel guider 32 respectively. Then, the rotatable reel 12 is slid along the shaft member 11 until the rotatable reel 12 is inserted into the outer end of the film roll 1. The film rolls 1 are held at the holding portions 112 of the shaft member 11.

The film rolls 1 are then locked at the holding portions 112 of the shaft member 11 by the roll locker 20 in a free-rotating manner by slidably passing the locking members 22 through the locking slots 21 respectively and engaging the detachable ends 232 of the locking bands 23 with the ends of the locking members 22 respectively.

(2) Dispensing Step of the Film Rolls 1.

Hold the dispensing handle 30 by the operator to unroll the film rolls 1 in a concurrent and controllable manner so as to wrap stretch films 1B of the film rolls 1 around the load.

Figure 4:
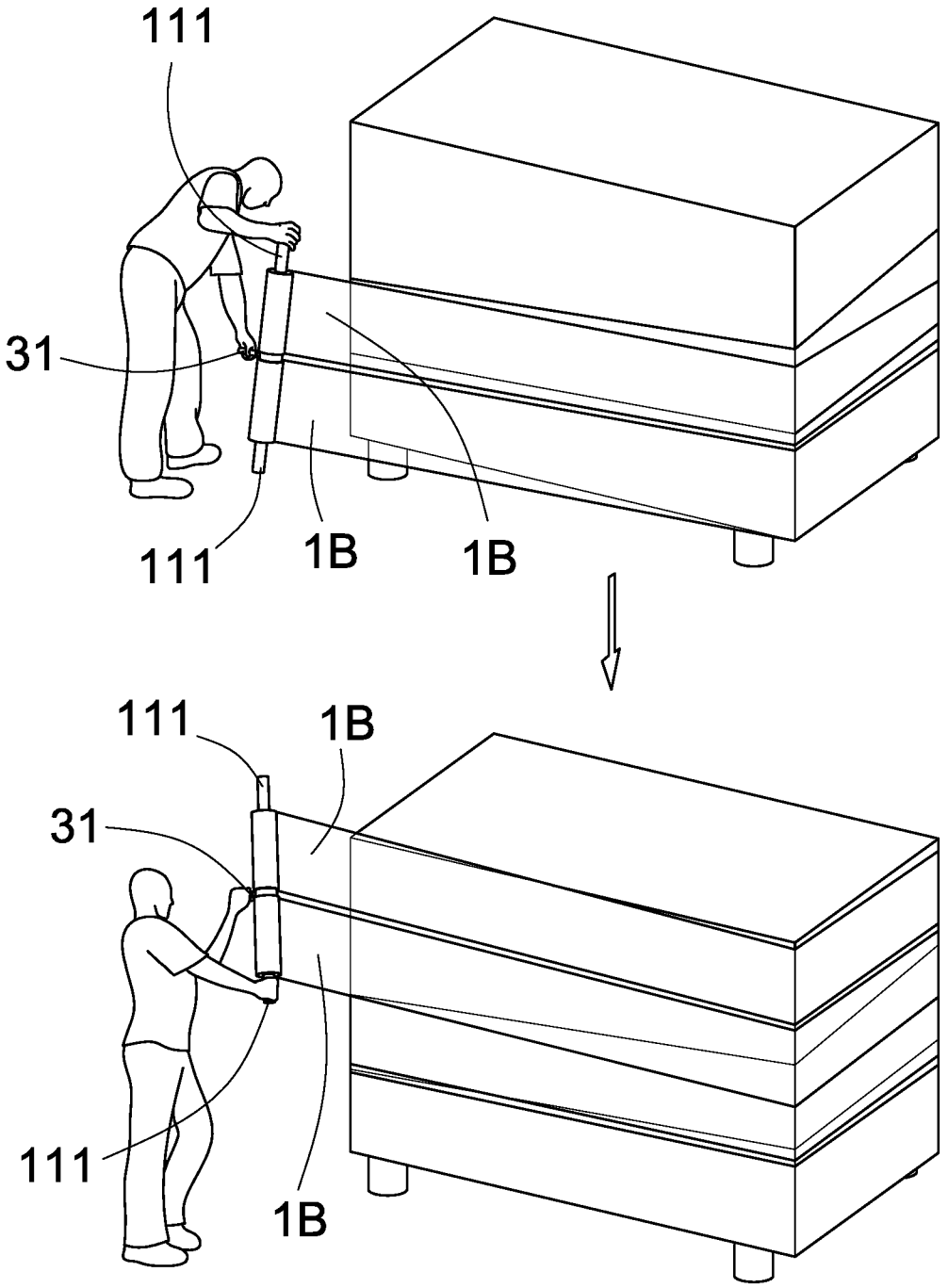
FIG. 4 illustrate an operation of the film wrapping apparatus according to the above preferred embodiment of the present invention.

Accordingly, the operator is able to affix free ends of the stretch films 1B at the load and to walk around the load for unrolling the film rolls so as to wrap the stretch films 1B around the load, preferably from bottom to top, as shown in FIG. 4.

As it is mentioned above, one of the handling portions 111 of the shaft member 11 is longer than another handling portion 111 thereof. When the shaft member 11 is held in a vertical manner via the dispensing handle 30 during the wrapping operation, the longer handling portion 111 of the shaft member 11 is located above the shorter handling portion 111 thereof. When wrapping the lower portion of the load, the shorter handling portion 111 of the shaft member 11 is positioned close to the ground in order to minimize the ground clearance between the film rolls 1 and the ground. At the same time, the operator is able to hold the longer handling portion 111 of the shaft member 11 to stabilize the shaft member 11 during the wrapping operation. In other words, one hand of the operator holds at the dispensing handle 30 while another hand of the operator holds at the longer handling portion 111 of the shaft member 11 to control the tension and speed of unrolling of the stretch films 1B during the wrapping operation. When moving the film wrapping apparatus upwardly to wrap the upper portion of the load, the operator is able to lift up the shaft member 11 via the dispensing handle 30 at the same time the operator is able to hold the shorter handling portion 111 of the shaft member 11 to stabilize the shaft member 11 during the wrapping operation. In other words, one hand of the operator holds at the dispensing handle 30 while another hand of the operator holds at the shorter handling portion 111 of the shaft member 11 to control the tension and speed of unrolling of the stretch films 1B during the wrapping operation. Therefore, throughout the entire wrapping operation, the tension and speed of unrolling of the stretch films 1B can be easily controlled via the two handling points of the film wrapping apparatus. It is worth mentioning that two film rolls 1 are unrolled to parallelly dispense two stretch films 1B at the same time, the walking distance of the operator, i.e. walking around the load, will be reduced in half so as to minimize the operation time for completing the wrapping operation of the load. Since the film rolls 1 are spacedly separated by the hand grip 31, the stretch films 1B of the film rolls 1 can be evenly dispensed in a balanced manner while the stretch films 1B of the film rolls 1 will not be overlapped with each other during the unrolling process. Once the load is wrapped by the stretch films 1B, the operator is able to tear off the stretch films 1B from the film rolls 1.

Figure 5:
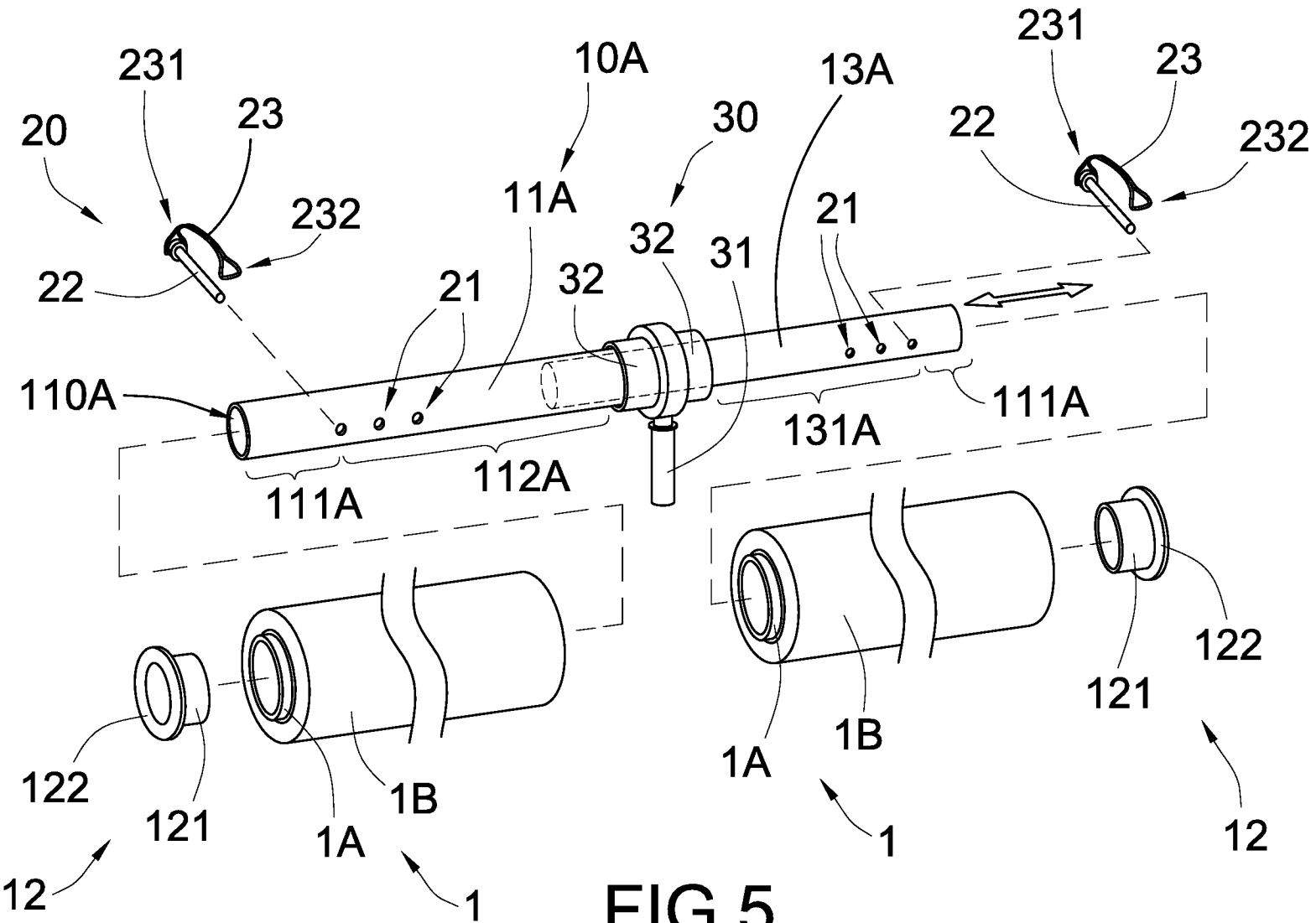
FIG. 5 illustrates an alternative mode of the film wrapping apparatus according to the above preferred embodiment of the present invention.

FIG. 5 illustrates an alternative mode of the film wrapping apparatus which can selectively hold one or more film rolls 1 for the wrapping operation. Accordingly, the roll holder 10A comprises a shaft member 11A having a holding portion 112A for holding a primary film roll 1 and an extendable member 13A coaxially and retractably extended from the shaft member 11A to provide an additional holding portion 131A for holding a secondary film roll 1. A length of the shaft member 11A is longer than a length of the extendable member 13A. A diameter of the shaft member 11A is larger than a diameter of the extendable member 13A.

In particular, the shaft member 11A has a receiving cavity 110A defining a closed end and an opened end, wherein the extendable member 13A is slidably coupled at the shaft member 11A via the opened end thereof. It is worth mentioning that the dispensing handle 30 is coupled at the shaft member 11A close to the opened end thereof. The extendable member 13A is slidably and coaxially moved between a retracted position and an extended position. At the retracted position, the extendable member 13A is slidably received in the receiving cavity 110A of the shaft member 11A, wherein only one holding portion 112A is provided to hold one film roll 1. At the extended position, the extendable member 13A is coaxially slid out of the receiving cavity 110A through the opened end of the shaft member 11A. Therefore, two holding portions 112A, 131A are provided to hold two film rolls 1 respectively. It is worth mentioning that at the extended position, the dispensing handle 30 is located between the holding portion 112A of the shaft member 11A and the holding portion 131A of the extendable member 13A. Preferably, the longer handling portion 111A is defined at the end portion of the shaft member 11A while the shorter handling portion 111A is defined at the end portion of the extendable member 13A. It is worth mentioning that any existing locking means can be incorporated with the roll holder 10A to lock up the extendable member 13A at the extended position.

The operator is able to selectively load one or two film rolls 1, wherein the roll holder 10A is able to hold one single film roll 1 at the retracted position of the extendable member 13A and is able to hold two film rolls 1 at the extended position of the extendable member 13A. The film rolls 1 are locked at the holding portions 112A, 131A via the roll locker 20, wherein the locking slots 21 are provided at the shaft member 11A and the extendable member 13A respectively, such that when the film rolls 1 are held at to the holding portions 112A, 131A, the locking members 22 and the locking bands 23 are capable of locking the film rolls 1 at the holding portions 112A, 131A respectively.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A film wrapping apparatus for wrapping two or more film rolls around a load, comprising:

a roll holder comprising an elongated shaft member having two holding portions coaxially aligned with each other;

a roll locker provided at each of said holding portions of said shaft member for releasably locking the film rolls at said holding portions respectively in a free-rotating manner; and a dispensing handle transversely extended from said shaft member at a position between said holding portions thereof, wherein said dispensing handle is arranged for being held by an operator to unroll the film rolls in a concurrent and controllable manner so as to wrap stretch films of the film rolls around the load; wherein said roll locker comprises one or more locking slots transversely extended through said shaft member adjacent to said holding portion thereof, and a locking member detachably passing through said locking slot for locking the film roll at said holding portion of said shaft member.

2. The film wrapping apparatus, as recited in claim 1, wherein said roll holder further comprises two rotatable reels rotatably and coaxially coupled at said shaft member for securely coupling at outer ends of the film rolls respectively.

3. The film wrapping apparatus, as recited in claim 2, wherein each of said rotatable reels comprises a rotating core adapted for coupling at and inserting into the outer end of the film roll, and an outer flange integrally and coaxially extended from an outer edge of said rotating core for covering at the outer end of the film roll, wherein a diameter of said rotating core is smaller than an inner diameter of the film roll while a diameter of said outer flange is larger than the inner diameter of the film roll.

4. The film wrapping apparatus, as recited in claim 1, wherein said roll locker further comprises a locking band, wherein two ends of said locking member are protruded out of said shaft member after said locking member is extended through said locking slot, wherein said locking band has a fixing end affixed to one of said ends of said locking member and a detachable end detachably coupled at another said end of said locking member to lock up said locking member at said shaft member.

5. The film wrapping apparatus, as recited in claim 1, wherein said dispensing handle comprises a hand grip transversely extended from said shaft member and two reel guiders extended from said hand grip in an opposite direction for coupling at inner ends of the film rolls respectively.

6. The film wrapping apparatus, as recited in claim 5, wherein said reel guiders are non-rotatably coupled at said shaft member.

7. The film wrapping apparatus, as recited in claim 1, wherein said shaft member further has a handling portion formed at each end portion of said shaft member at a position that said holding portion is formed between said handling portion and said dispensing handle.

8. The film wrapping apparatus, as recited in claim 7, wherein a length of one of said handling portion of said shaft member is longer than a length of another said handling portion thereof.

9. The film wrapping apparatus, as recited in claim 1, wherein each of said holding portion of said shaft member has a length of at least 1 foot.

10. A film wrapping apparatus, for wrapping a film roll, having a width of at least 1 foot, around a load, comprising:

a roll holder comprising an elongated shaft member having a handling portion defined at one end portion of said shaft member and a holding portion for holding the film roll at said holding portion; and a dispensing handle transversely extended from said shaft member at a position that said holding portion of said shaft member is located between said handling portion thereof and said dispensing handle, wherein said handling portion of said shaft member and said dispensing handle provide at least two holding points for being held by an operator to unroll the film roll in a controllable manner so as to wrap stretch film of the film roll around the load; wherein said roll locker comprises one or more locking slots transversely extended through said shaft member adjacent to said holding portion thereof, and a locking member detachably passing through said locking slot for locking the film roll at said holding portion of said shaft member.

11. The film wrapping apparatus, as recited in claim 10, further comprising a roll locker provided at said holding portion of said shaft member for releasably locking the film roll at said holding portion in a free-rotating manner.

12. The film wrapping apparatus, as recited in claim 10, wherein said roll locker further comprises a locking band, wherein two ends of said locking member are protruded out of said shaft member after said locking member is extended through said locking slot, wherein said locking band has a fixing end affixed to one of said ends of said locking member and a detachable end detachably coupled at another said end of said locking member to lock up said locking member at said shaft member.

13. The film wrapping apparatus, as recited in claim 10, wherein said roll holder further comprises a rotatable reel rotatably and coaxially coupled at said shaft member for securely coupling at an outer end of the film roll.

14. The film wrapping apparatus, as recited in claim 13, wherein said rotatable reel comprises a rotating core adapted for coupling at and inserting into the outer end of the film roll, and an outer flange integrally and coaxially extended from an outer edge of said rotating core for covering at the outer end of the film roll, wherein a diameter of said rotating core is smaller than an inner diameter of the film roll while a diameter of said outer flange is larger than the inner diameter of the film roll.

15. The film wrapping apparatus, as recited in claim 10, wherein said dispensing handle comprises a hand grip transversely extended from said shaft member and a reel guider extended from said hand grip for coupling at an inner end of the film roll.

16. The film wrapping apparatus, as recited in claim 15, wherein said reel guider is non-rotatably coupled at said shaft member.

17. The film wrapping apparatus, as recited in claim 10, wherein said roll holder further comprises an extendable member coaxially and retractably extended from said shaft member to provide an additional holding portion for holding a secondary film roll.

18. The film wrapping apparatus, as recited in claim 17, wherein said shaft member has a receiving cavity, wherein said extendable member is slidably and coaxially moved between a retracted position that said extendable member is slidably received in said receiving cavity and an extended position that said extendable member is slid out of said receiving cavity to locate said dispensing handle between said holding portion of said shaft member and said additional holding portion of said extendable member.

* * * * *